US010865995B2

(12) United States Patent
Chavan et al.

(10) Patent No.: US 10,865,995 B2
(45) Date of Patent: Dec. 15, 2020

(54) VENTILATION SYSTEM FOR INDUCTION COOKTOP

(71) Applicant: Whirlpool Corporation, Benton Harbor, MI (US)

(72) Inventors: Ajay Yashwant Chavan, Pune (IN); Arunkumar Balasubramanian, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 566 days.

(21) Appl. No.: 15/834,563

(22) Filed: Dec. 7, 2017

(65) Prior Publication Data

US 2018/0100658 A1 Apr. 12, 2018

Related U.S. Application Data

(62) Division of application No. 13/546,069, filed on Jul. 11, 2012, now Pat. No. 9,841,196.

(51) Int. Cl.
*F24C 15/10* (2006.01)
*H05B 6/12* (2006.01)

(52) U.S. Cl.
CPC ..... *F24C 15/101* (2013.01); *H05B 6/1263* (2013.01); *H05B 2206/022* (2013.01)

(58) Field of Classification Search
CPC ..... H05B 6/1263; H05B 2206/022; F24C 15/101
USPC ..... 219/620
See application file for complete search history.

(56) References Cited

U.S. PATENT DOCUMENTS 3,927,658 A * 12/1975 Olthuis ..... F24C 15/10 126/214 A
4,415,788 A 11/1983 Field
4,490,596 A 12/1984 Hirai et al.
4,549,052 A * 10/1985 Simon ..... H05B 6/1263 126/37 A
4,551,600 A 11/1985 Miyagawa et al.
4,627,415 A * 12/1986 Kamo ..... F24C 15/108 126/21 R
4,665,893 A 5/1987 Miyagawa et al.
4,983,799 A 1/1991 Bonnet
5,446,268 A 8/1995 Chen
(Continued)

FOREIGN PATENT DOCUMENTS

EP 0663567 7/1995
JP H02234384 9/1990

*Primary Examiner* — Dana Ross
*Assistant Examiner* — Kuangyue Chen
(74) *Attorney, Agent, or Firm* — Diederiks & Whitelaw, PLC

(57) ABSTRACT

A countertop mounted cooking appliance includes a chassis upon which is arranged a cooktop. A peripheral side portion of the chassis includes at least one opening and a control box is mounted in the chassis for housing control elements and associated electronics. An inner duct extends over at least a portion of the control box, while an outer duct extends across the at least one opening along the peripheral side portion to the countertop. A fan is mounted within the chassis wherein, when the fan is activated, a cooling airflow is developed and directed through the inner duct, out of the chassis, and through the outer duct prior to being exhaust through a gap created between the cooktop and the countertop by a trim piece.

20 Claims, 9 Drawing Sheets

(56) References Cited

U.S. PATENT DOCUMENTS

| | | | | |
|---|---|---|---|---|
| 6,410,892 | B1 * | 6/2002 | Peschl | F24C 15/102 126/218 |
| 6,600,139 | B2 * | 7/2003 | Perschl | F24C 15/10 219/460.1 |
| 7,049,552 | B2 * | 5/2006 | Arntz | F24C 15/101 126/15 R |
| 7,135,661 | B2 * | 11/2006 | Park | H05B 6/1263 219/623 |
| 7,533,666 | B2 | 5/2009 | Hosoi et al. | |
| 7,687,748 | B2 | 3/2010 | Gagas | |
| 7,696,454 | B2 * | 4/2010 | Nam | F24C 3/126 219/393 |
| 8,003,924 | B2 | 8/2011 | Kim et al. | |
| 8,692,169 | B2 | 4/2014 | Lin | |
| 2008/0142512 | A1 * | 6/2008 | Kim | F24C 15/101 219/757 |
| 2009/0127247 | A1 * | 5/2009 | Adam | A47B 77/08 219/452.11 |
| 2010/0072189 | A1 * | 3/2010 | Marchand | F24C 15/101 219/449.1 |
| 2010/0163549 | A1 | 7/2010 | Gagas | |
| 2013/0340742 | A1 * | 12/2013 | Sosso | B23P 19/00 126/299 D |
| 2014/0014649 | A1 * | 1/2014 | Chavan | F24C 15/101 219/620 |
| 2014/0150771 | A1 * | 6/2014 | Gayle | F24C 15/101 126/299 D |

* cited by examiner

VENTILATION SYSTEM FOR INDUCTION COOKTOP

CROSS-REFERENCE TO RELATED APPLICATIONS

This application is a divisional of U.S. application Ser. No. 13/546,069, filed on Jul. 11, 2012 and titled "Ventilation System for a Cooktop". The entire content of this application is incorporated herein by reference.

BACKGROUND

Technical Field

The present disclosure pertains to the art of cooking appliances and, more particularly, to a ventilation system for developing an airflow that cools control elements, as well as an internal chassis portion, of a cooktop, particularly an induction cooktop.

Description of the Related Art

In general, smooth-top cooking surfaces are well known in the art and are generally associated with a range or mounted in a countertop. A typical cooktop includes a frame having secured thereto a plurality of heating elements which are covered by a glass-ceramic panel or other type of cooking surface. In addition, the cooktop includes a plurality of control elements, each of which is associated with operating a corresponding heating element mounted to the cooktop. In many cases, the cooktop includes openings that enable cooling air to pass through a top portion of the cooktop to draw away heat generated by the heating elements. The airflow can also be directed by the control elements to protect any associated electronics.

Generally, manufacturers mount the control elements in a separate area of the frame. This arrangement eliminates the need for complicated mounting brackets associated with mounting controls or switches alongside the heating elements on the cooktop. In addition, mounting the control elements remote from the heating elements eliminates, or at least reduces, the need to shield control electronics from heat generated by the heating elements. However, the addition of a separate area dedicated to the controls reduces the overall available surface area of the cooktop. Add to that the need for a cooling air inlet opening, and the available cooking space is considerably reduced.

Based on the above, there exists a need for a system, which provides for effective cooling of electronic components in an appliance cooktop, specifically a countertop mounted, induction cooktop. More specifically, there exists a need for a ventilation system that employs at least one air passage defining structure, which assures an ample flow of ventilation air in order to enhance the life of the electronic components.

SUMMARY

The present disclosure is directed to a ventilation system for a cooking appliance, particularly an induction cooktop mounted in a countertop. The cooking appliance includes a frame which supports at least one heating element and associated electronic control components. The frame may include a peripheral side portion that establishes a chassis upon which is arranged a glass cooktop. In accordance with the present disclosure, the peripheral side portion may include at least one opening that allows air to pass into and out of the chassis.

In accordance with one aspect of the disclosure, a trim structure may be provided between the induction cooktop and the countertop in order to lift the cooktop above the upper surface of the countertop and for establishing a substantially peripheral gap. In accordance with another aspect of the disclosure, at least one of an inner and an outer duct may be provided for the chassis of the cooking appliance, with the inner duct extending over at least a portion of an electronic control box mounted within the chassis. The control box may include a plurality of side walls that define a housing for electrical components, and/or a heat sink for the electrical components, associated with controlling the at least one heating element of the cooking appliance. In addition, at least one outer duct may extend between the countertop and the chassis adjacent an end of the inner duct.

With this arrangement, a flow of cooling air may be drawn into the inner duct in order to draw heat from the electronic components and then delivered to the outer duct, which directs the flow of cooling air to exhaust through a section of the peripheral gap. A fan may be mounted within the chassis to establish a negative pressure to cause the air to flow through at least one of the inner and outer ducts. The inlet air can be drawn from directly adjacent the chassis or through a section of the peripheral gap and guided through a first outer duct to certain openings in the peripheral side wall of the chassis prior to being let to the inner duct.

Additional objects, features and advantages of the present disclosure will become more readily apparent from the following detailed description of specific embodiments when taken in conjunction with the drawings wherein like reference numerals refer to corresponding parts in the several views.

DETAILED DESCRIPTION

Figure 1:
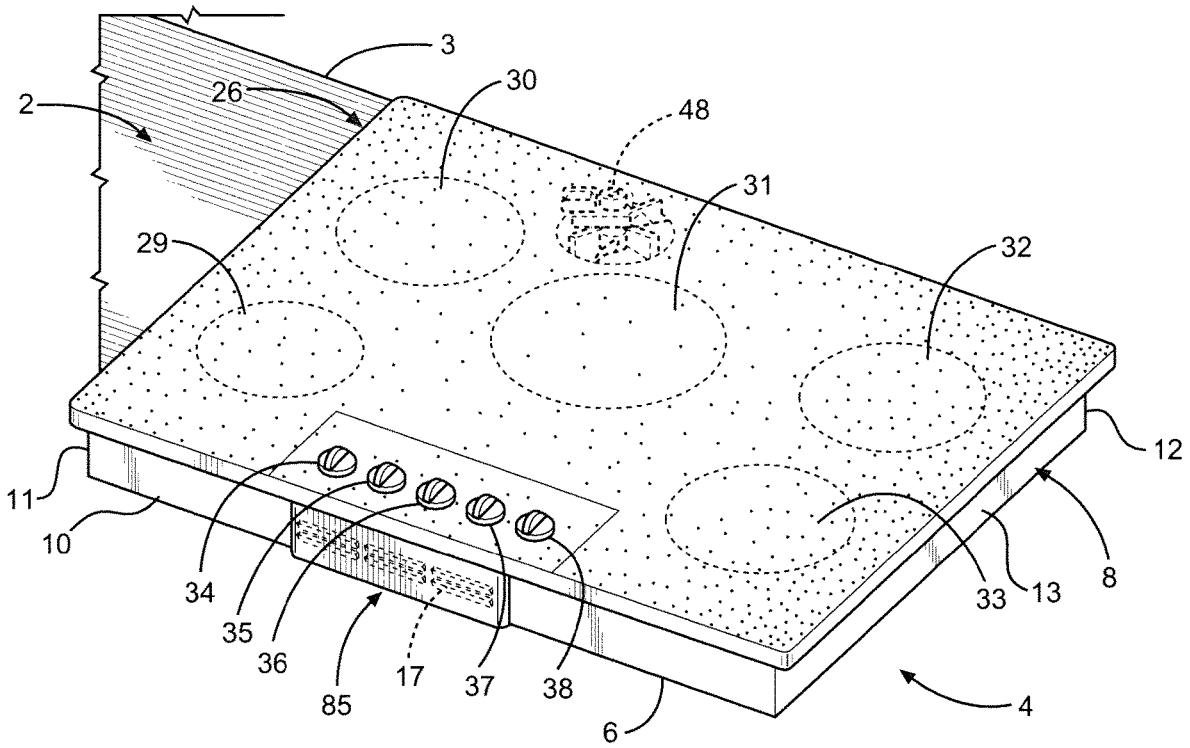
FIG. 1 is an upper right perspective view of an induction cooktop incorporating a ventilation system constructed in accordance with the present disclosure.

With initial reference to FIG. 1, a cooking appliance constructed in accordance with the present disclosure is generally shown at 2. Although the actual cooking appliance into which the present disclosure can be incorporated may vary, the exemplary embodiments are shown in connection with a cooking appliance 2 depicted as an induction cooktop model that is adapted to be arranged in a kitchen countertop, which is partially indicated at 3. However, it should be understood that the cooking appliance 2 is not limited to this particular model type and could also be anyone of various oven range configurations, e.g., both free-standing and slide-in ranges. In the embodiment shown, cooking appliance 2 includes a burner box or chassis 4 having a bottom wall or surface 6 and a peripheral side portion 8. As shown, peripheral side portion 8 extends substantially perpendicularly upward from bottom wall 6 and is constituted by a plurality of upstanding side walls 10-13 formed with at least one spaced opening, as indicated at 17.

Cooking appliance 2 is also provided with a cooking surface or cooktop 26, which in the embodiment shown, is constituted by a smooth glass/ceramic cooktop. Cooktop 26 may be provided with a plurality of cooking zones 29-33 containing heating elements (not separately labeled), illustrated as sheathed, electric heating elements, which are selectively operated by a corresponding plurality of control elements, illustrated as knobs 34-38. It should be known that the control elements may also be buttons, toggles or other such elements. Although not shown in the embodiment depicted, cooking appliance 2 could be provided with a downdraft fan unit arranged on cooktop 26 in order to draw away smoke or other byproducts that may be generated during cooking upon cooktop 26. Also shown mounted with chassis 4 is a fan or blower assembly 48 which, as will be more fully discussed below, may be employed to create a flow of ventilation air through at least a specified portion of chassis 4.

Figure 2:
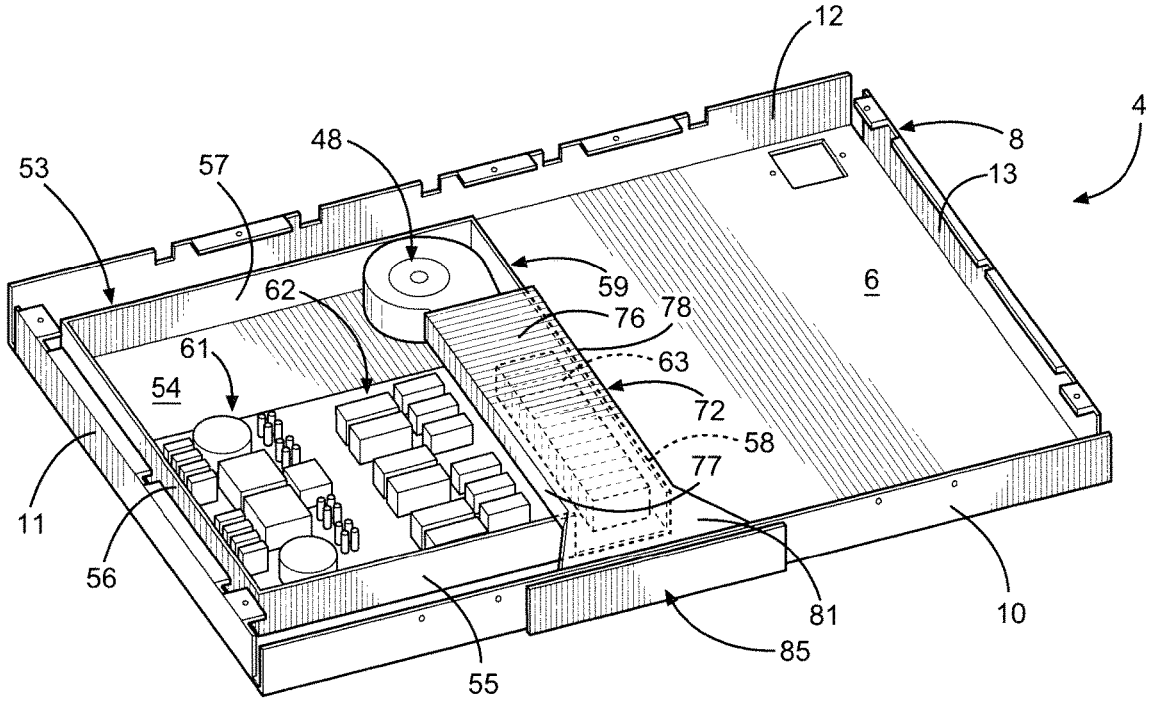
FIG. 2 is an upper perspective view of the ventilation system showing inner and outer ducts employed in accordance with a first ventilation embodiment.

With reference to FIG. 2, a control box 53 is illustrated as arranged within chassis 4. However, the control box 53 is not limited to a specific mounting position and may be configured adjacent to and connected with the chassis 4. In the embodiment shown, control box 53 is offset to one side of chassis 4, with control box 53 including a bottom 54 and a plurality of side walls 55-58 that collectively define a housing 59. Arranged within housing 59 are various electronic components, such as generally indicated at 61 and 62, that are associated with control elements 34-38. Due to the heat generated by operation of cooking appliance 2, it is desired to ventilate at least the portion of chassis 4 containing housing 59 in order to protect the various electronic components arranged therein.

As illustrated, control box 53 contains a heat sink 63 for the electronics in housing 59, with the present disclosure being described in connection with providing a ventilation system to assure an adequate flow of cooling air for the electronics by directing cooling air into housing 59 and across heat sink 63. To this end, blower assembly 48, when operated, creates a cooling airflow through at least a portion of chassis 4 and it is the manner in which air is directed into, guided through, and exhausted from chassis 4 to which the present disclosure is particularly concerned as discussed more fully below.

Figure 3:
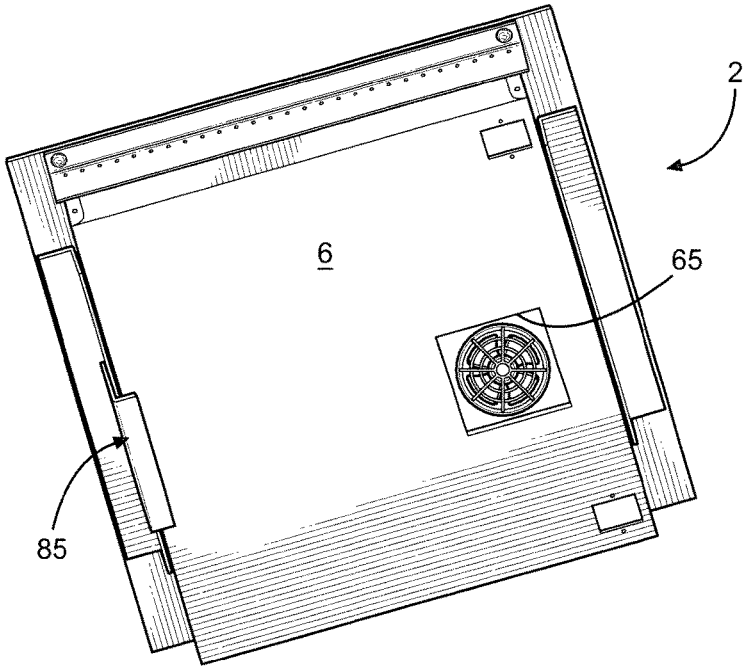
FIG. 3 is a lower perspective view of the induction cooktop of FIG. 1 illustrating an intake arrangement for the first ventilation embodiment.
Figure 4:
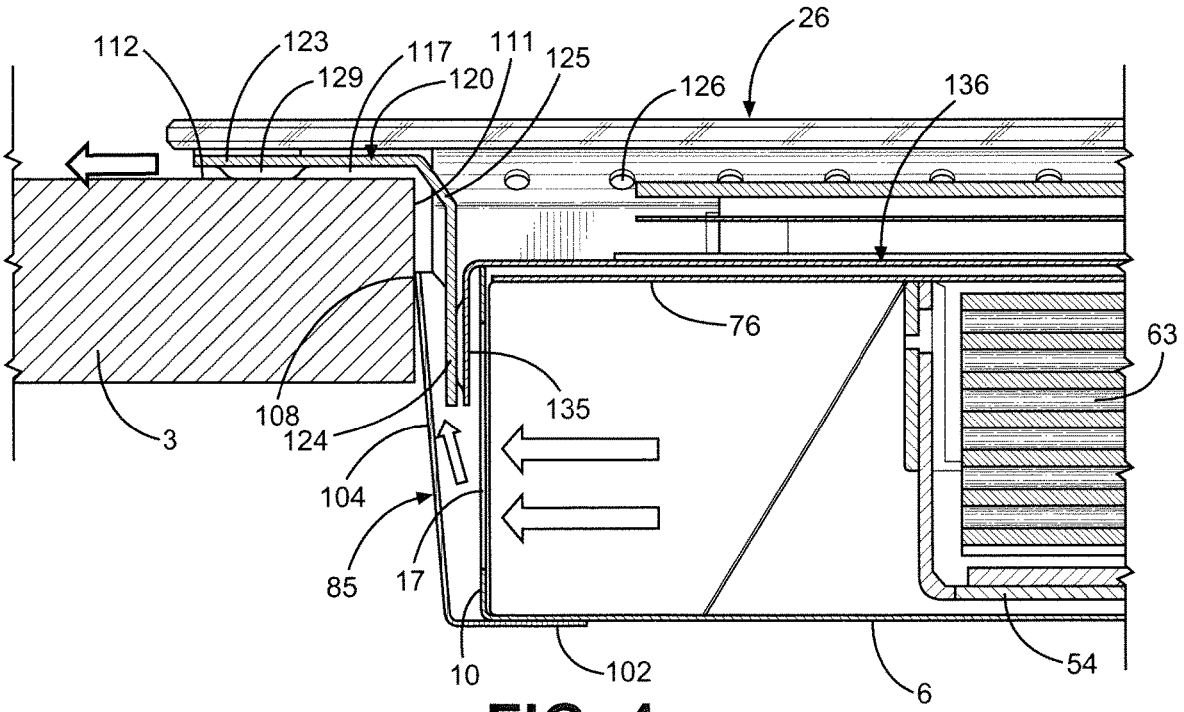
FIG. 4 is a cross-sectional view of a portion of the ventilation system for the induction cooktop of FIGS. 1-3.

With particular reference to the embodiment shown in FIGS. 2 and 3, chassis 4 is provided with an opening 65 in bottom 6. Blower assembly 48 is positioned directly above opening 65 and leads to an inner duct 72. Inner duct 72 is shown to be formed from an upper plate 76 and side plates 77 and 78 which are interconnected to establish a substantially inverted, U-shape. As best shown in FIG. 2, inner duct 72 extends over a portion of housing 59, specifically the portion of housing 59 including heat sink 63. Inner duct 72 is also provided with a diverging zone 81, which is shown to be provided outside of housing 59 and leads to directly adjacent peripheral side portion 8, of chassis 4. Also shown in connection with this embodiment is an outer duct generally indicated at 85. As best shown in FIG. 4, outer duct 85 includes a first end portion 102, which is secured to bottom wall 6 of chassis 4 and an angled wall portion 104 terminating in an upper end portion 108. As shown, first end portion 102 is fixedly secured to bottom wall 6 of chassis 4 such that angled wall portion 104 is cantilevered from chassis 4. In the embodiment shown, wall portion 104 is angled from first end portion 102 through an obtuse angle, while extending at an acute angle with respect to side wall 10 of chassis 4. As shown, upper end portion 108 abuts an interior body portion 111 of countertop 3 and terminates short of an upper surface 112 of countertop 3.

Figure 5:
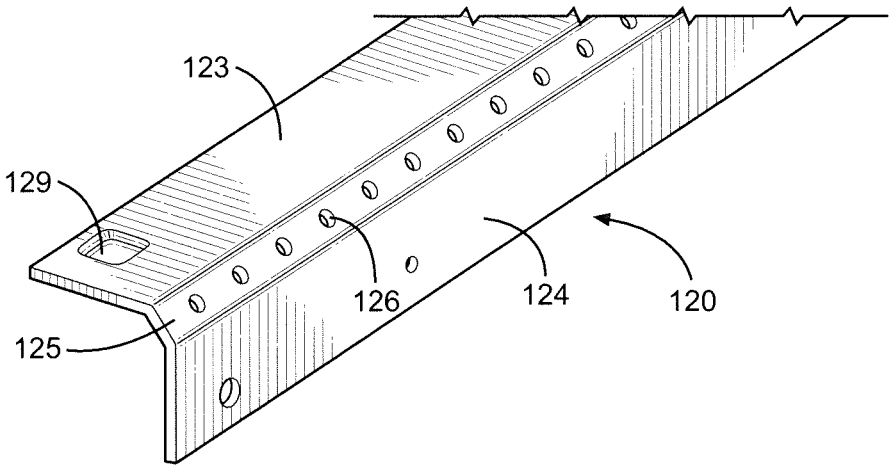
FIG. 5 is a partial perspective view of a trim piece employed with the ventilation system of the present disclosure.

When cooking appliance 2 is mounted in kitchen countertop 3, a gap 117 is established between cooktop 26 and upper surface 112 due to the inclusion of a trim piece or trim member generally indicated at 120. Reference will now be made to FIG. 5 in describing the construction of trim piece 120 in accordance with a first embodiment of the disclosure. As shown in FIG. 5, trim piece 120 includes a first leg 123, a second leg 124 and a connecting leg 125. Provided along connecting leg 125 is a series of spaced openings 126. Also provided at spaced locations along first leg 123 is a series of supporting nubs 129. However, the openings 126 are not limited to a specific size, shape or quantity and are merely illustrated as a plurality of circular openings. As shown in FIG. 4, trim piece 120 is arranged such that first leg 123 is positioned between cooktop 26 and upper surface 112 of countertop 3, while second leg 124 extends substantially parallel to both inner body portion 111 of countertop 3 and side wall 10 of chassis 4. In particular, nubs 129 engage upper surface 112 of countertop 3 to establish gap 117, while cooktop 26 rests directly upon first leg 123. At the same time, connecting leg 125 extends around a corner between upper surface 112 and interior body portion 111 of countertop 3 and second leg 124 is spaced from both inner body portion 111 and angled wall portion 104 of outer duct 85. In addition, second leg 124 is either fixed to or positioned directly against a downturned portion 135 of an interior cover 136 provided in chassis 4.

With this overall arrangement, operation of blower assembly 48 causes an airflow to be drawn into chassis 4 through opening 65, with the airflow being directed into and through inner duct 72 so as to flow over heat sink 63. Thereafter, the airflow leaves chassis 4 through at least one opening 17 exposed to outer duct 85. The airflow is then guided within outer duct 85 between angled wall portion 104 and second leg 124 of trim piece 120 so as to reach gap 117 between countertop 3 and cooktop 26. Thereafter, the airflow is exhausted through gap 117 as established by trim piece 120 by the inclusion of first leg 123 arranged between cooktop 26 and countertop 3. At the same time, a separate flow of ventilation air can be directed through openings 126 from directly below cooktop 26.

Figure 6:
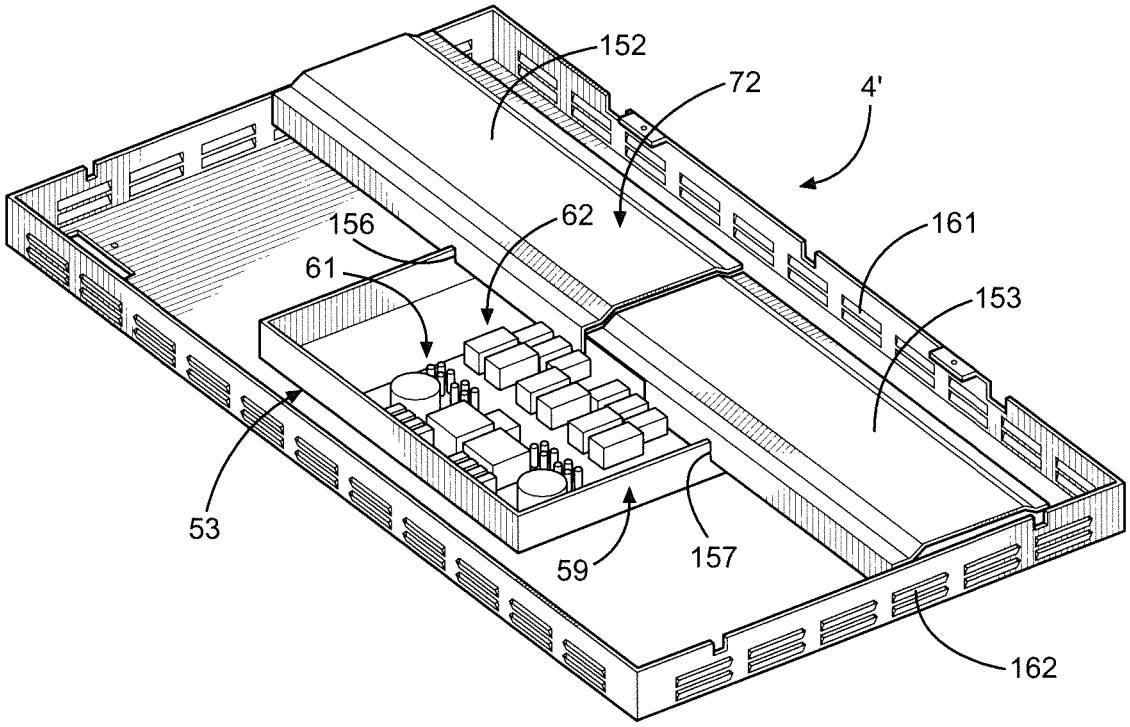
FIG. 6 is an upper perspective view of an induction cooktop chassis incorporating a second ventilation embodiment in accordance with the disclosure.
Figure 7:
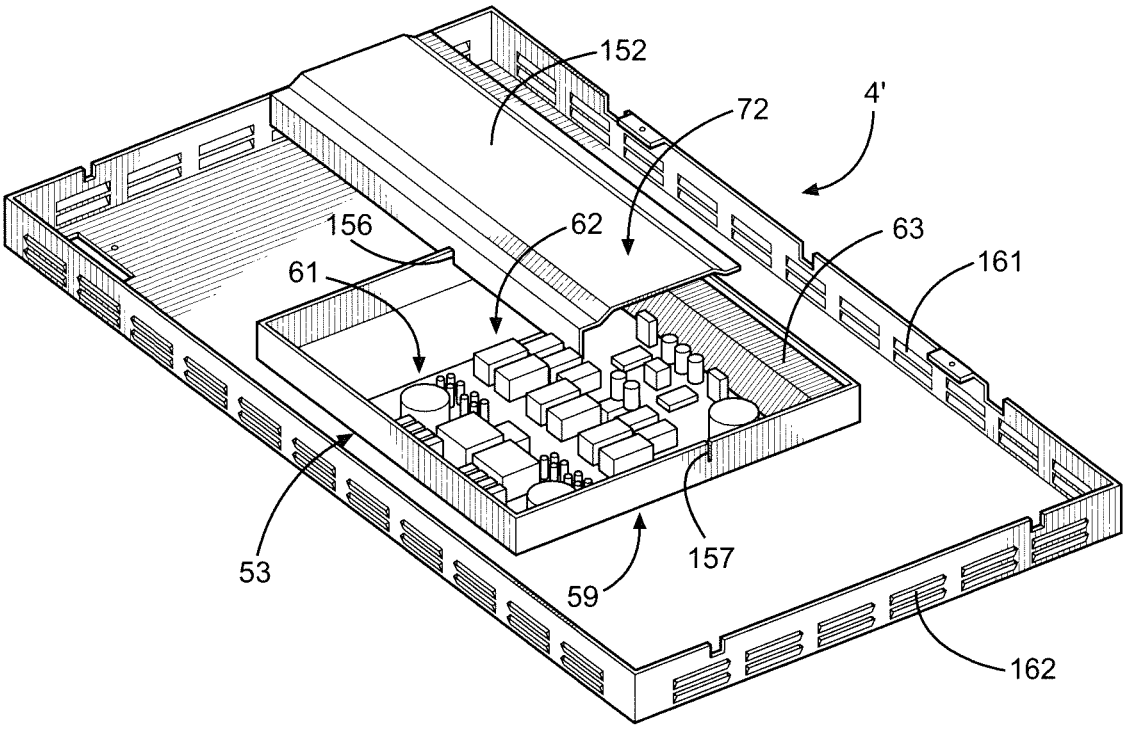
FIG. 7 is an upper perspective view of the induction cooktop chassis of FIG. 6, showing a portion of the second ventilation embodiment removed.

In connection with the overall disclosure, the combination of inner and outer ducts and a trim piece may be employed to establish the ventilation system. Certainly, the construction and arrangement of these various components can greatly vary in accordance with the overall disclosure. By way of further examples, reference will be made to the additional figures to set forth other embodiments. For instance, FIGS. 6 and 7 illustrate an embodiment wherein a chassis 4 may be provided with an inner duct 72 defined by a first inner duct section 152 and a second inner duct section 153 that extend longitudinally within chassis 4. In accordance with this embodiment, housing 53 may be provided with cut-outs 156 and 157 as part of housing 59, with inner duct sections 152 and 153 mating with housing 59 at cut-outs 156 and 157 respectively. Although not shown, housing 59 would also include heat sink 63 over which inner duct sections 152 and 153 are positioned.

In accordance with this embodiment, chassis 4 is provided with a plurality of openings 161 arranged substantially around the entire periphery, with at least one of the openings 161 having an associated louver 162. At this point, it should be recognized that FIGS. 6 and 7 are only being provided to illustrate another arrangement for the inner duct such that an outer duct 85 and an associated trim piece 120 are simply not shown for the sake of clarity. Furthermore, blower assembly 48 can be provided beneath one of first and second inner duct sections 152 and 153 to draw air through openings 161 in one side of chassis 4 and direct the airflow to openings 161 of the other side of chassis 4, with either or both of the inlet and exhaust airflows being directed through an associated outer duct (not shown).

Figure 8:
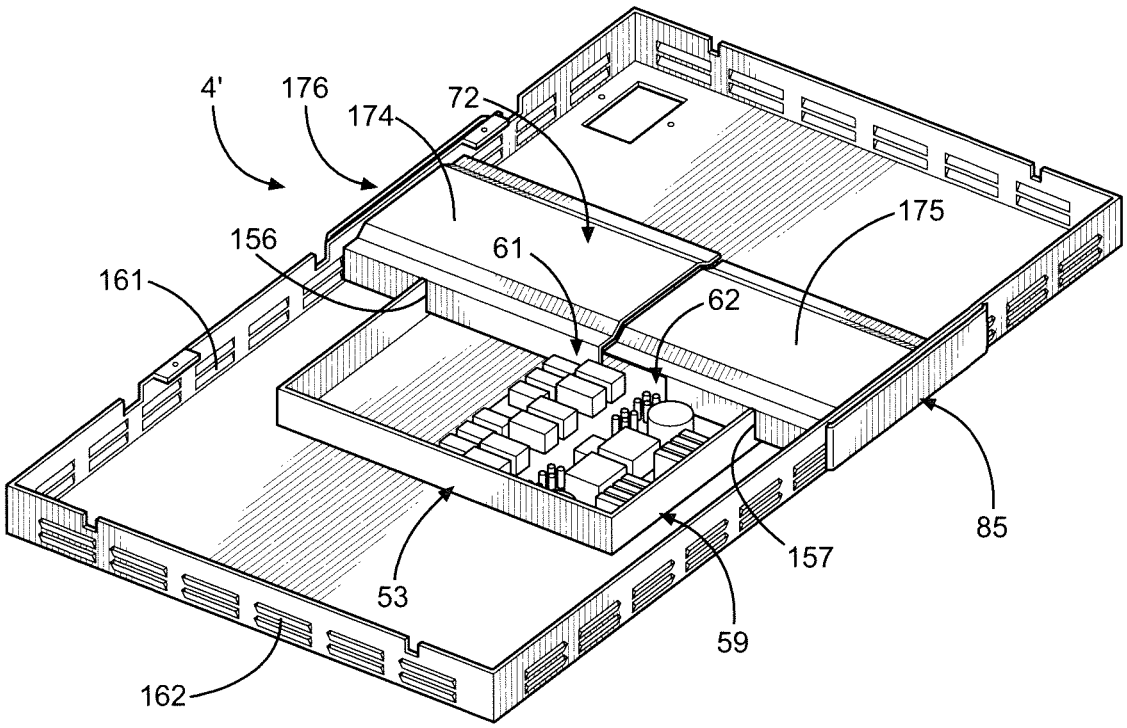
FIG. 8 is an upper perspective view of an induction cooktop chassis incorporating a third ventilation embodiment in accordance with the disclosure.
Figure 9:
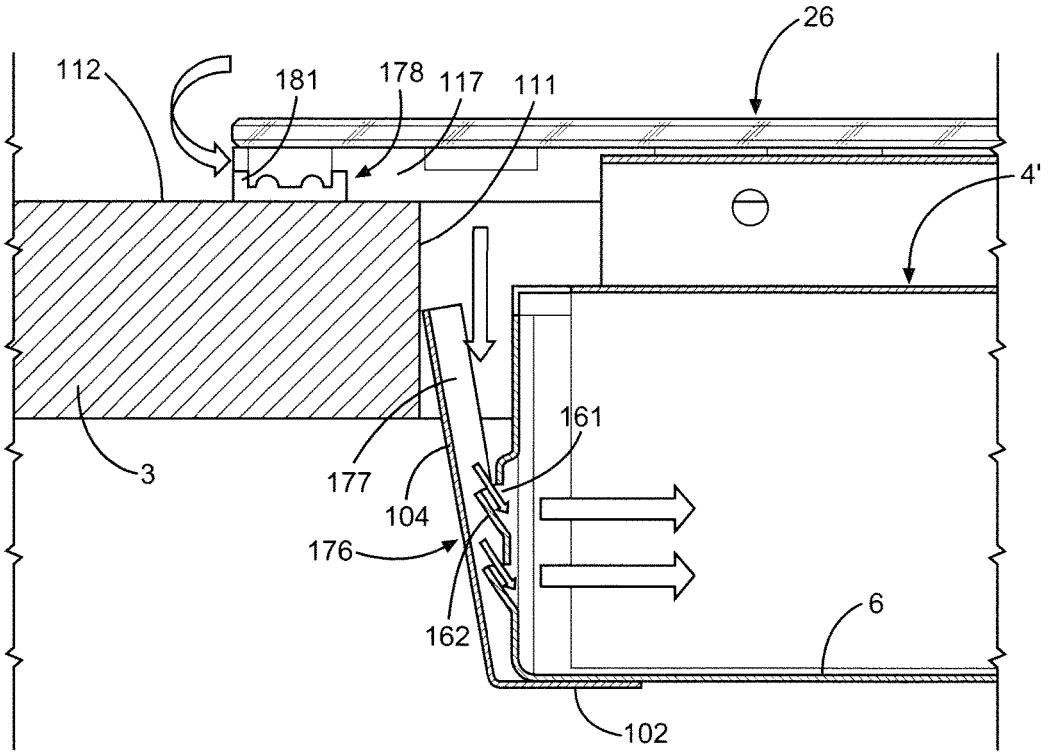
FIG. 9 is a cross-sectional view of an intake portion of the ventilation embodiments of FIGS. 5-8.

FIG. 8 shows another arrangement wherein the inner duct is defined by inner duct sections 174 and 175 that extend widthwise or across the shorter dimension of the chassis 4. Here, outer duct 85 is shown for exhausting the airflow, while a second outer duct 176 is mounted in the same manner as outer duct 85 but provides for an inlet flow of air from between the countertop 3 and the cooktop 26. More particularly, as best shown in FIG. 9, outer duct 176 is constructed in a manner substantially identical to outer duct 85 and therefore corresponding reference numerals have been used in this figure. As shown, outer duct 176 includes ears 177, which further aid in guiding the airflow into chassis 4. As also shown in this figure, a trim piece 178 is simply positioned between cooktop 26 and countertop 3 to establish gap 117. At this point, it should also be noted that trim piece 178 has a solid splash shield portion 181 extending directly from upper surface 112 of countertop 3 so as to prevent the flow of fluid from directly upon upper surface 112 into gap 117. Still, openings are established within trim piece 178 to permit an airflow directly below cooktop 26 and into gap 117 which can then flow through outer duct 176 and respective openings 161, as guided by louvers 162, and into chassis 4.

Figure 10:
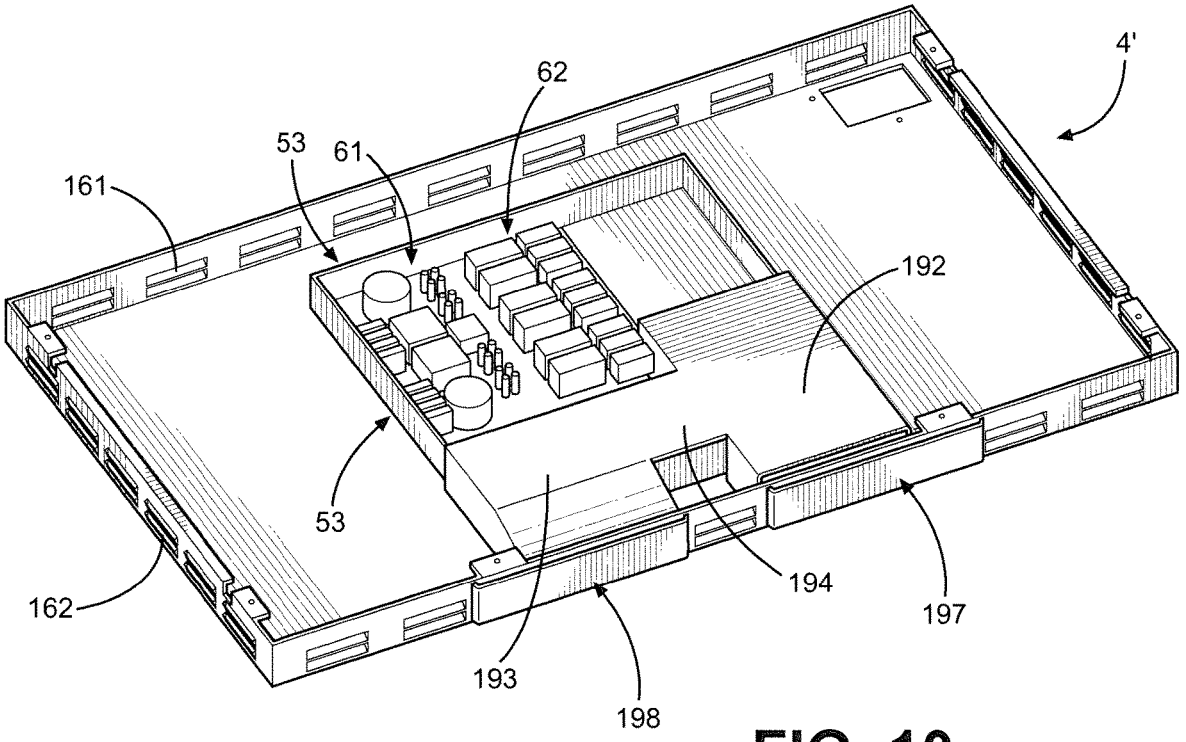
FIG. 10 is an upper perspective view of an induction cooktop chassis incorporating a fourth ventilation embodiment in accordance with the disclosure.

Again, it must be recognized that various ducting arrangements can be employed without departing from the present disclosure. For instance, FIG. 10 illustrates an embodiment wherein the inner duct is established by a first inner duct portion 192, which is linked to a second inner duct portion 193 through a connecting duct 194. The overall outer duct configuration in this embodiment is constituted by a first outer duct 197 and a second outer duct 198. Each of the outer ducts 197 and 198 are constructed and mounted according to the same configuration of outer ducts 85 and 176 such that this structure will not be reiterated here. In this embodiment, blower assembly 48 is provided beneath one of inner ducts 192 or 193. For instance, blower assembly 48 can be provided beneath first inner duct 192 to draw a flow of air from between cooktop 26 and countertop 3 into gap 117 and through first outer duct 197, with the airflow then being directed over heat sink 63 provided beneath connecting duct 94 and second inner duct 193. Thereafter, the air can be exhausted out of second outer duct 198.

Figure 11:
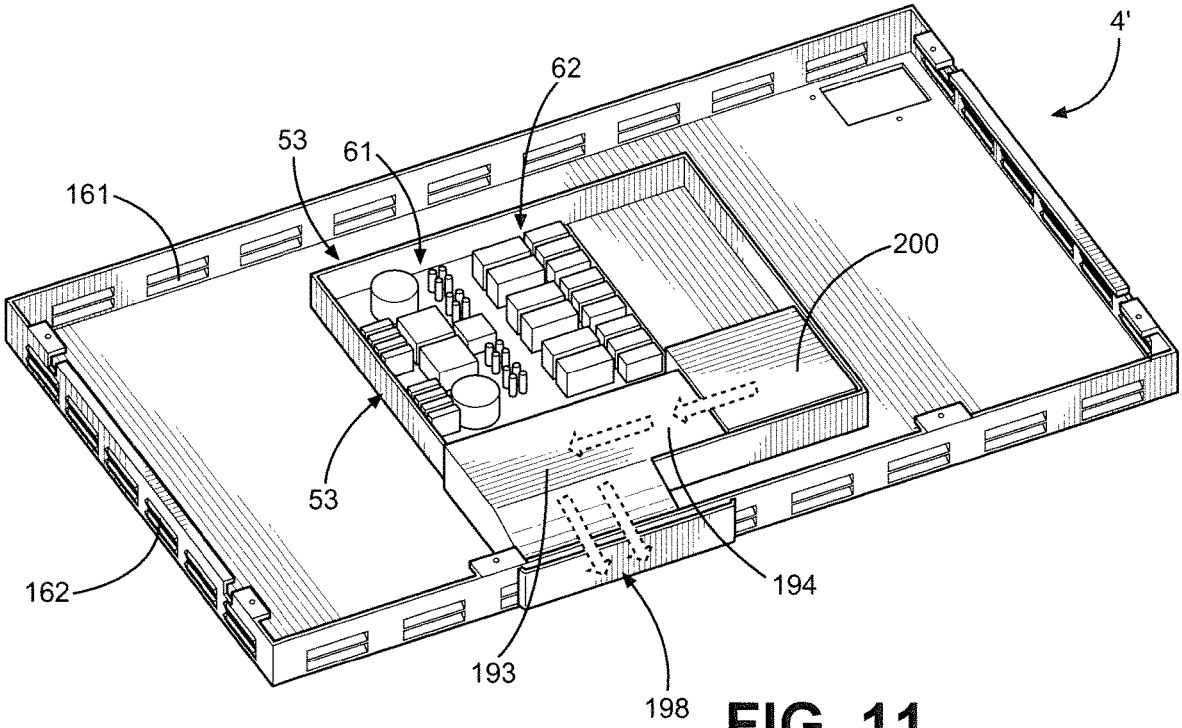
FIG. 11 is an upper perspective view of an induction cooktop chassis incorporating a fifth ventilation embodiment in accordance with the disclosure.

FIG. 11 shows a slightly modified version of this embodiment wherein first inner duct 192 is replaced by an inner duct 200 under which blower assembly 48, although not shown, is positioned and which would be aligned with a lower opening corresponding to opening 65 referenced in connection with FIG. 3. Therefore, instead of receiving an inlet airflow through a first outer duct as set forth in the embodiment of FIG. 10, this embodiment would receive an airflow from beneath chassis 4 as part of the overall ventilation system.

Figure 12:
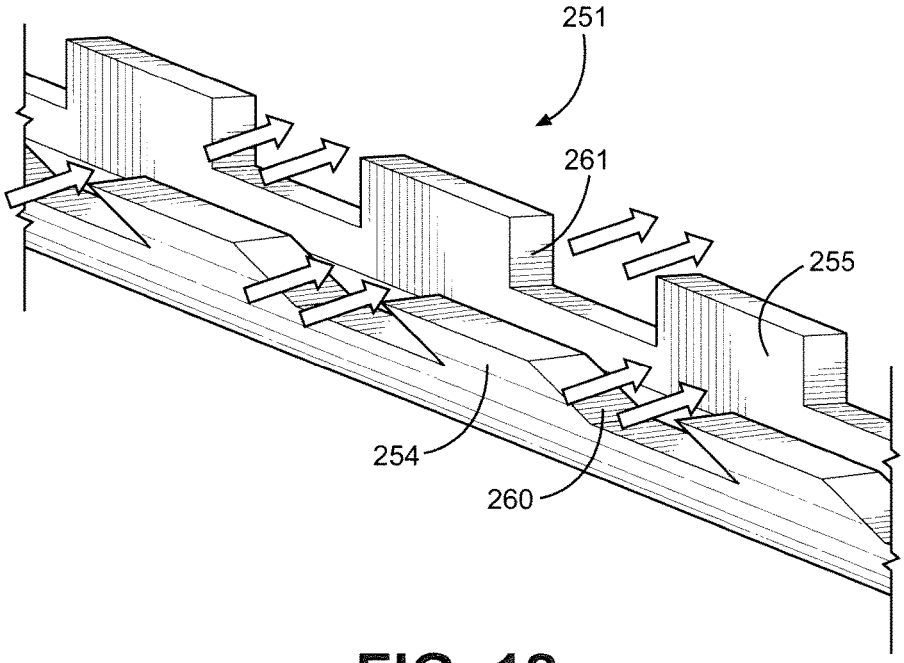
FIG. 12 is a partial perspective view of a trim piece similar to FIG. 5 but according to a second embodiment employed with the ventilation system of the present disclosure.
Figure 13:
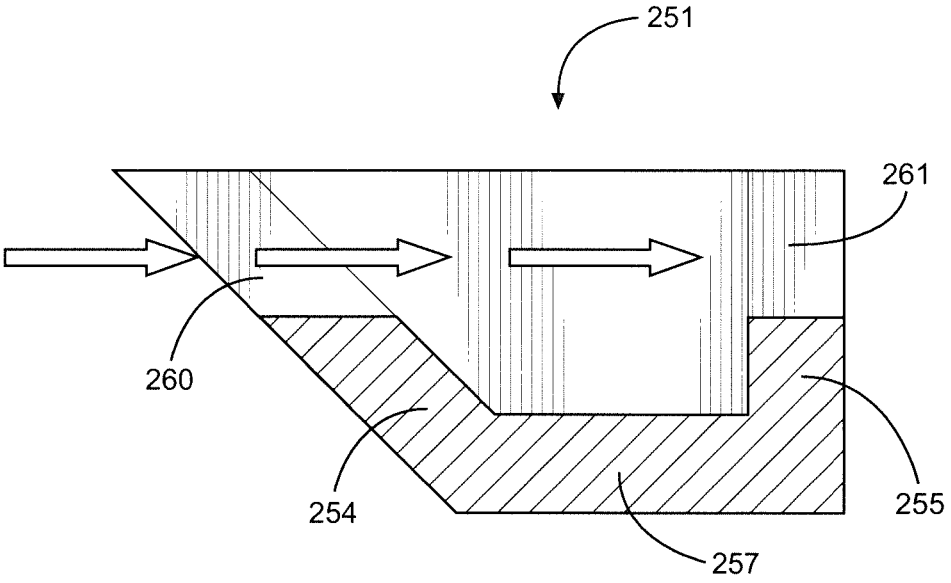
FIG. 13 is a cross-sectional view of the trim piece of FIG. 12.
Figure 14:
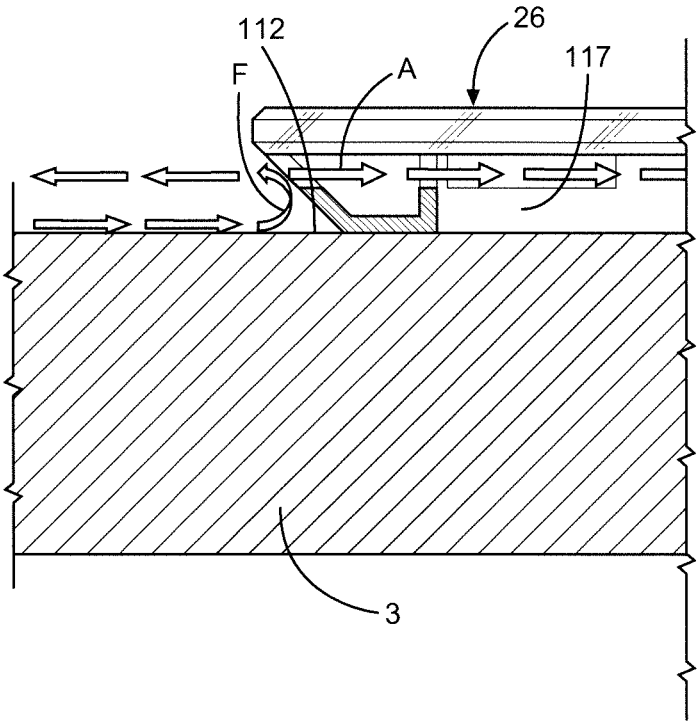
FIG. 14 is a partial cross-sectional view illustrating the trim piece of FIG. 12 installed between the induction cooktop and a countertop.

Based on the discussions above, it should be readily apparent that different configurations for the trim piece can also be employed in connection with the disclosure. That is, exemplary trim pieces have been described with respect to at least FIGS. 4 and 9 and additional trim piece embodiments will now be described. More specifically, FIGS. 12-14 illustrates a trim piece 251 shown to include an outer trim portion 254 and an inner trim portion 255 which are joined by connecting portion 257. Inner and outer portions 254 and 255 constitute splash shield portions in a manner directly corresponding to that discussed above with respect to the embodiment of FIG. 9. As illustrated, outer trim portion 254 is provided with a first set of spaced cut-outs 260, while inner trim portion 255 is provided with a second set of spaced cut-outs 261. Cut-outs 260 and 261 can either be aligned or offset. With this arrangement, as perhaps best illustrated in FIGS. 13 and 14, trim piece 251 has a solid portion projecting up from upper surface 112 of countertop 3 and establishes an inlet airflow based on the first and second, spaced cut-outs 260 and 261. That is, FIG. 14 shows the airflow A by arrows entering directly beneath cooktop 26, while any fluid flow, represented by arrows F, directly on upper surface 112 of countertop 3 will be deflected away from gap 117 by trim piece 251.

Figure 15:
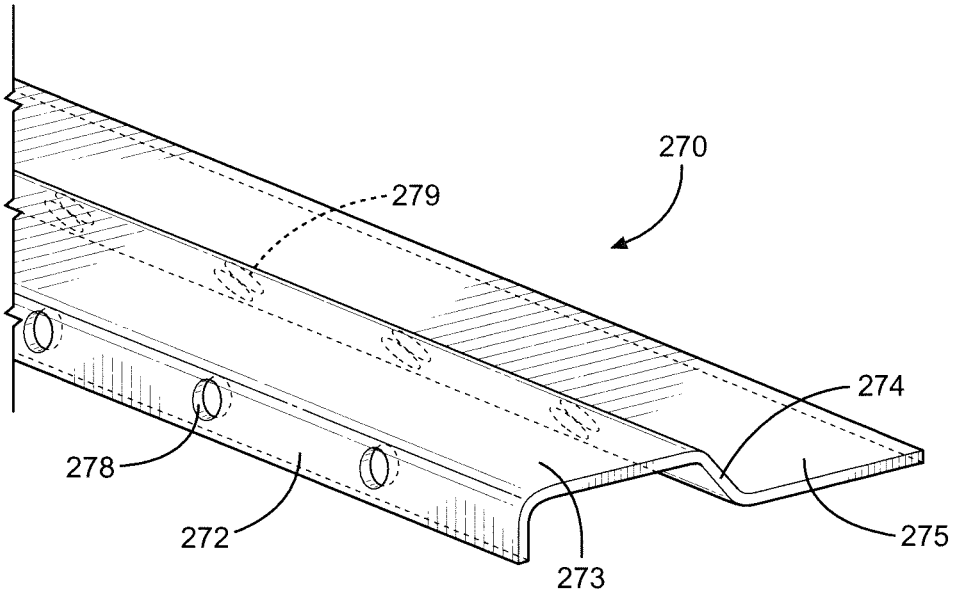
FIG. 15 is a partial perspective view of a trim piece similar to FIG. 5 but according to a third embodiment employed with the ventilation system of the present disclosure.
Figure 16:
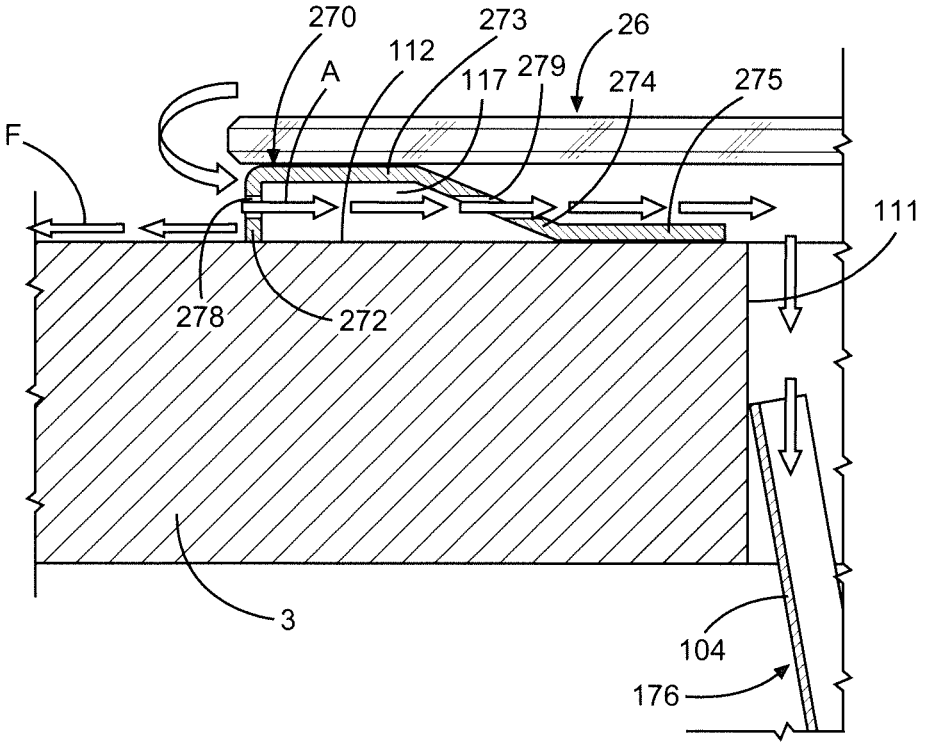
FIG. 16 is a partial cross-sectional view illustrating the trim piece of FIG. 15 installed between the induction cooktop and a countertop.

A similar advantageous trim arrangement is set forth in accordance with the embodiment in FIGS. 15 and 16. Here, a trim piece 270 is shown to include an outer trim or splash shield portion 272, which leads to a first plateau 273 upon which cooktop 26 can be directly supported. From first plateau 273, trim piece 270 extends into a downturned portion 274 leading to a base extension 275. Provided in outer trim portion 272 is a first series of openings 278 and provided in downturned portion 274 is a second series of openings 279. Like cut-outs 260 and 261, openings 278 and 279 can either be aligned or offset. In either case, when trim piece 270 is mounted in the manner illustrated in FIG. 16, airflow A is permitted to flow into the first series of openings 278, beneath plateau 273 and through the second series of openings 279 so as to reach gap 117 and eventually be guided to a respective outer duct 176. On the other hand, fluid flow F will be deflected by splash shield portion 272.

Figure 17:
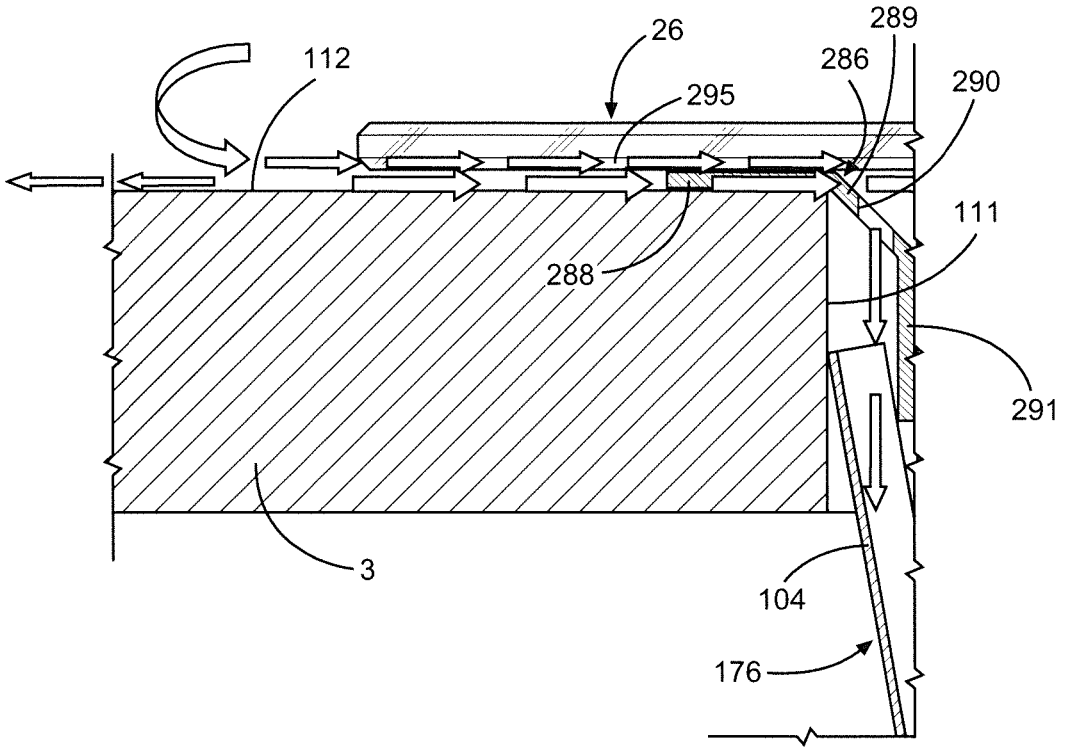
FIG. 17 is a partial cross-sectional view illustrating a trim piece according to a fourth embodiment installed between the induction cooktop and a countertop.

By way of a still further embodiment wherein a trim piece is located further inward of an edge portion of cooktop 26, reference is made to FIG. 17. More specifically, the embodiment of FIG. 17 employs a trim piece 286 having an outer trim or splash shield portion 288 leading to an angled portion 289 that is provided with openings 290, and a downturned leg 291 which is spaced from outer duct 176. In accordance with this embodiment, outer trim portion 288 functions to prevent fluid from entering beyond trim piece 286 while a lower portion of cooktop 26 is provided with ribs 295 to support cooktop 26 upon trim piece 286 while allowing for an airflow directly between trim piece 286 and cooktop 26, with the airflow being permitted to flow downward through openings 290 in order to lead to outer duct 176 and then flow into the chassis for ventilation purposes in a manner directly corresponding to that described above. Of course, the same arrangement can be employed for exhausting a ventilation airflow as well.

Based on the above, it should be readily apparent that the cooking appliance of the present disclosure effectively establishes a ventilation system for providing a flow of cooling air for electronic components of the cooking appliance, with the ventilation system employing the use of at least one trim member, an inner duct and an outer duct, which synergistically combine to enable a cooling airflow to be directed into a chassis of the cooking appliance, pass through the inner and outer ducts, and exhaust through a gap established by the trim member in order to effectively cool the electronic components for extended life. As exemplified by the numerous embodiments described above, various configurations and airflow pathways can be established through the use of the inner and outer ducts and the trim piece, while these components can take various configurations themselves without departing from the various aspects of the disclosure. Therefore, although described with respect to the specific embodiments of the disclosure, it should be understood that various changes and sectional modifications can be made without departing from the spirit thereof. For instance, the particular location of the blower assembly can be varied depending upon the configuration of the heating elements and the ducting. In addition, while shown in connection with a cooking appliance operating on electricity, the present disclosure could also be incorporated into a gas appliance, including a gas-under-glass cooktop unit. In general, the disclosed embodiments are only intended to be limited by the scope of the following claims.

What is claimed is:

1. A method of cooling components supported in a chassis of a cooking appliance mounted in a countertop, the method comprising:

activating a blower assembly mounted to the chassis to create an airflow;

directing the airflow into the chassis through at least one opening formed in the chassis;

directing the airflow through an inner duct provided in the chassis to cool the components;

directing the airflow from the inner duct to an outer duct extending from a peripheral side wall portion of the chassis;

guiding the airflow within the outer duct to between the countertop and a cooktop of the cooking appliance; and exhausting the airflow through a gap established by at least one trim piece arranged between the cooktop and the countertop.

2. The method of claim 1, further comprising directing the airflow through an end portion of the inner duct that extends to the at least one opening.

3. The method of claim 2, further comprising directing the airflow to the gap with the outer duct, wherein the inner duct includes an inlet and an outlet for the airflow, the outlet being at the end portion of the inner duct and spaced from the outer duct by the peripheral side wall portion such that the outer duct is positioned outside of the chassis.

4. The method of claim 3, wherein the at least one opening includes multiple openings, the method further comprising placing an inlet region of the outer duct in fluid communication with the multiple openings, wherein the outer duct includes a single outlet region.

5. The method of claim 3, further comprising guiding the airflow within another outer duct positioned outside of the chassis and leading from the gap to the inlet of the inner duct.

6. The method of claim 1, wherein directing the airflow from the inner duct includes directing the airflow to the peripheral side wall portion which includes first, second, third and fourth side walls, with the first and second side walls being arranged opposite the third and fourth side walls respectively, and wherein:

1) the inner duct includes an inlet positioned at the first side wall and an outlet positioned at the third side wall; or 2) the inner duct includes an inlet and an outlet, each positioned at the third side wall.

7. The method of claim 1, wherein exhausting the airflow through the gap includes exhausting the airflow through at least one splash shield portion of the at least one trim member, said at least one splash shield portion being configured to define the gap.

8. The method of claim 7, wherein exhausting the airflow through the gap includes exhausting the airflow through inner and outer splash shield portions of the at least one splash shield portion.

9. The method of claim 1, wherein exhausting the airflow through the gap includes exhausting the airflow through a series of spaced holes formed in a splash shield portion formed in the at least one trim piece, said series of spaced holes collectively constituting the gap.

10. The method of claim 1, wherein directing the airflow through the inner duct includes directing the airflow over at least a portion of a control box, wherein the components are housed in the control box.

11. A method of cooling components supported in a chassis of a cooking appliance mounted in a countertop, the method comprising:

activating a blower assembly mounted to the chassis to create an airflow;

directing the airflow into the chassis through at least one opening formed in the chassis;

directing the airflow through an inner duct provided in the chassis to cool the components, wherein the inner duct includes an end portion extending to at least one of the at least one opening;

directing the airflow from the inner duct to an outer duct arranged outside of the chassis;

guiding the airflow within the outer duct to between the countertop and a cooktop of the cooking appliance; and exhausting the airflow through a gap established by at least one trim piece arranged between the cooktop and the countertop.

12. The method of claim 11, wherein directing the airflow from the inner duct to the outer duct includes directing the airflow from the inner duct to the outer duct which extends from a peripheral side wall portion of the chassis.

13. The method of claim 12, further comprising directing the airflow to the gap with the outer duct, wherein the inner duct includes an inlet and an outlet for the airflow, the outlet being at the end portion of the inner duct and spaced from the outer duct by the peripheral side wall portion such that the outer duct is positioned outside of the chassis.

14. The method of claim 13, wherein the at least one opening includes multiple openings, the method further comprising placing an inlet region of the outer duct in fluid communication with the multiple openings, wherein the outer duct includes a single outlet region.

15. The method of claim 13, further comprising guiding the airflow within another outer duct positioned outside of the chassis and leading from the gap to the inlet of the inner duct.

16. The method of claim 11, wherein directing the airflow from the inner duct includes directing the airflow to a peripheral side wall portion of the chassis which includes first, second, third and fourth side walls, with the first and second side walls being arranged opposite the third and fourth side walls respectively, and wherein:

1) the inner duct includes an inlet positioned at the first side wall and an outlet positioned at the third side wall; or 2) the inner duct includes an inlet and an outlet, each positioned at the third side wall.

17. The method of claim 11, wherein exhausting the airflow through the gap includes exhausting the airflow through at least one splash shield portion of the at least one trim member, said at least one splash shield portion being configured to define the gap.

18. The method of claim 17, wherein exhausting the airflow through the gap includes exhausting the airflow through inner and outer splash shield portions of the at least one splash shield portion.

19. The method of claim 11, wherein exhausting the airflow through the gap includes exhausting the airflow through a series of spaced holes formed in a splash shield portion formed in the at least one trim piece, said series of spaced holes collectively constituting the gap.

20. The method of claim 11, wherein directing the airflow through the inner duct includes directing the airflow over at least a portion of a control box, wherein the components are housed in the control box.

* * * * *